US011139606B2

(12) United States Patent
Nito

(10) Patent No.: US 11,139,606 B2
(45) Date of Patent: Oct. 5, 2021

(54) CONNECTOR WITH A PRESS-FITTING NUT ACCOMMODATION PORTION

(71) Applicant: SUMITOMO WIRING SYSTEMS, LTD., Yokkaichi (JP)

(72) Inventor: Ayaka Nito, Yokkaichi (JP)

(73) Assignee: SUMITOMO WIRING SYSTEMS, LTD., Yokkaichi (JP)

( * ) Notice: Subject to any disclaimer, the term of this patent is extended or adjusted under 35 U.S.C. 154(b) by 0 days.

(21) Appl. No.: 16/919,994

(22) Filed: Jul. 2, 2020

(65) Prior Publication Data

US 2021/0013663 A1 Jan. 14, 2021

(30) Foreign Application Priority Data

Jul. 9, 2019 (JP) ..... JP2019-127519

(51) Int. Cl.
*H01R 13/426* (2006.01)

(52) U.S. Cl.
CPC ..... *H01R 13/426* (2013.01)

(58) Field of Classification Search
CPC ..... H01R 13/426; H01R 13/621; H01R 12/7047; H01R 4/301; H01R 4/34; H02K 5/22; H02K 5/225; F16B 41/002
See application file for complete search history.

(56) References Cited

U.S. PATENT DOCUMENTS 5,795,117 A 8/1998 Onoda
10,082,171 B2 * 9/2018 Yamauchi ..... F16B 4/004
10,263,490 B2 * 4/2019 Chang ..... H01R 9/18

FOREIGN PATENT DOCUMENTS

JP H09296815 A 11/1997

* cited by examiner

*Primary Examiner* — Vanessa Girardi
(74) *Attorney, Agent, or Firm* — Loza & Loza, LLP

(57) ABSTRACT

A connector includes a nut accommodation portion into which a nut is press-fitted and accommodated in a press-fitting direction. The nut accommodation portion includes an accommodation hole, which extends through a connector housing in the press-fitting direction of the nut, and an upper surface of a terminal connection portion of a connection terminal, which is exposed from the accommodation hole. The accommodation hole includes a through hole, which has a tetragonal shape as viewed in the press-fitting direction of the nut, and a recessed portion, which is formed in each of four corners of the through hole. The recessed portions are recessed toward an outer side of the through hole to locally expand a contour of the through hole.

9 Claims, 7 Drawing Sheets

CONNECTOR WITH A PRESS-FITTING NUT ACCOMMODATION PORTION

BACKGROUND

Field of the Disclosure

The present disclosure relates to a connector.

Related Art

A conventional connector includes a housing that is formed from a synthetic resin and has a nut accommodation portion. A metal nut is press-fitted and fixed to the nut accommodation portion (for example, refer to Japanese Laid-Open Patent Publication No. 9-296815). This type of nut accommodation portion has an inner wall surface including a rib that extends in a press-fitting direction.

SUMMARY

The rib formed on the inner wall surface of the nut accommodation portion may be scraped when the metal nut is press-fitted. Consequently, chips created by the scraping will collect on a bottom surface of the nut accommodation portion and cause tilting or floating of the nut. This may lower the fastened nut positioning precision. However, if the rib is not formed, dimensional errors or the like may hinder accommodation of the nut in the nut accommodation portion.

It is an object of the following description to provide a connecter that limits conventional decreases in the fastened nut positioning precision.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A connector in accordance with the present disclosure includes a connector housing, a connection terminal, and a nut accommodation portion. The connection terminal is attached to the connector housing. A nut is press-fitted and accommodated into the nut accommodation portion in a press-fitting direction. The nut accommodation portion includes an accommodation hole and an end surface of the connection terminal, which is exposed from the accommodation hole. The accommodation hole extends through the connector housing in the press-fitting direction. The accommodation hole includes a through hole and a recessed portion. The through hole has a tetragonal shape as viewed in the press-fitting direction. The recessed portion is formed in each of four corners of the through hole. The recessed portion is recessed toward an outer side of the through hole to locally expand a contour of the through hole.

The connector in accordance with the present description has an effect of limiting decreases in the fastened nut positioning precision.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
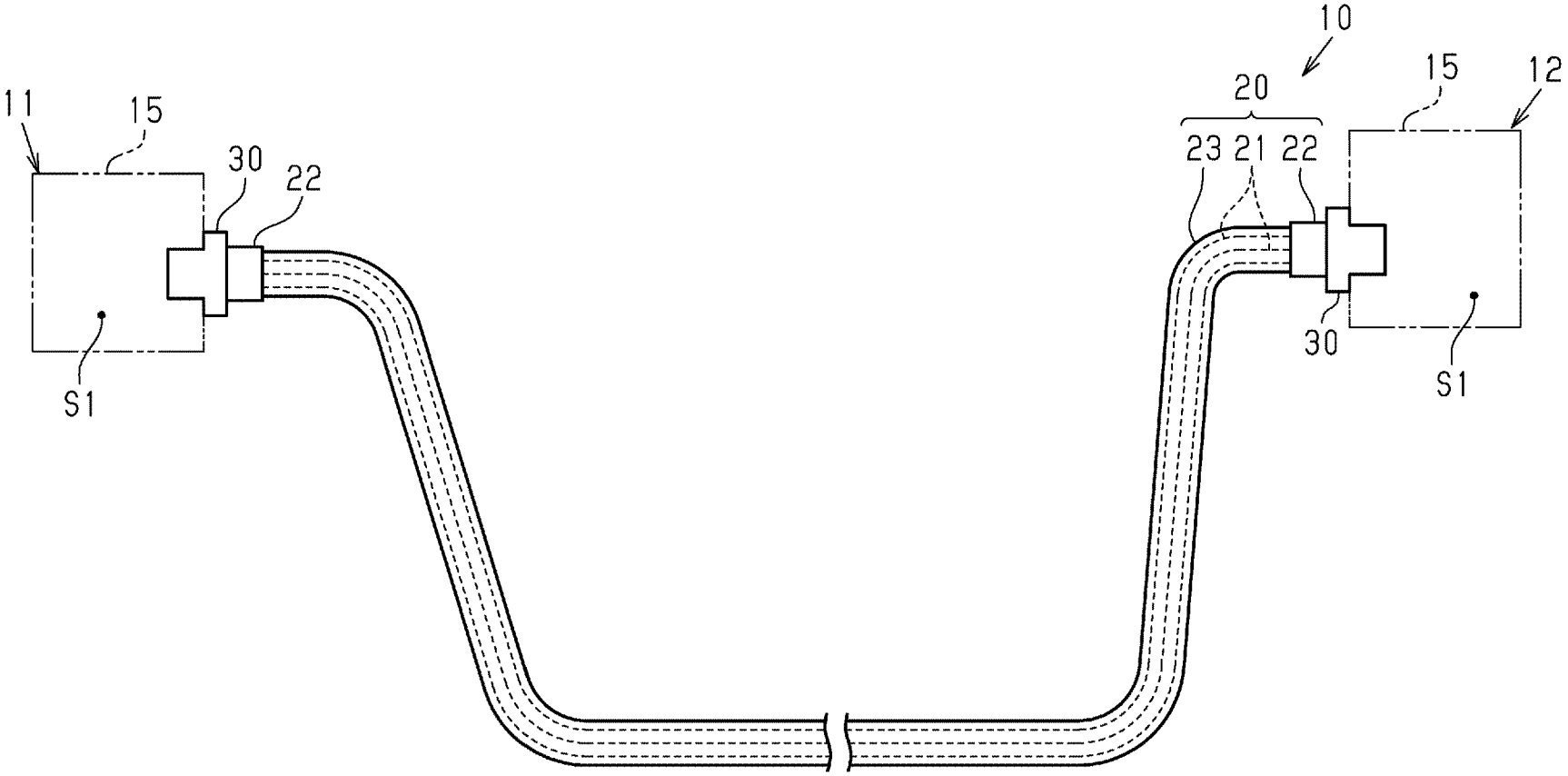
FIG. 1 is a schematic diagram showing an electroconductive path of one embodiment.

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

The embodiment of the present disclosure will now be described.

[1] A connector in accordance with the present disclosure includes a connector housing, a connection terminal, and a nut accommodation portion. The connection terminal is attached to the connector housing. A nut is press-fitted and accommodated into the nut accommodation portion in a press-fitting direction. The nut accommodation portion includes an accommodation hole and an end surface of the connection terminal, which is exposed from the accommodation hole. The accommodation hole extends through the connector housing in the press-fitting direction and includes a through hole and a recessed portion. The through hole has a tetragonal shape as viewed in the press-fitting direction. The recessed portion is formed in each of four corners of the through hole and recessed toward an outer side of the through hole to locally expand a contour of the through hole.

This structure forms the recessed portions in the four corners of the through hole that are recessed toward the outer side of the through hole and locally expand the contour of the through hole. The formation of the recessed portions allows for expansion of the space in the four corners of the through hole. This forms gaps between the corners of the nut, which is press-fitted into the accommodation hole, and the corners of the accommodation hole (i.e. corners of recessed portion). The gaps allow for a tolerance of dimensional differences resulting from dimensional errors, thermal expansion differences, or the like. Thus, the nut is accommodated in the accommodation hole with a high rate of precision.

When the inner wall surface of a conventional nut accommodation portion does not include a rib, if the radius of the roundness of the corner of the nut is smaller than the radius of the roundness of the corner of the nut accommodation portion, the corner of the nut may interfere with the corner of the nut accommodation portion. This scraping forms chips when the nut is press-fitted in the nut accommodation portion.

In contrast, in the above-described configuration, a gap is formed between the corner of the nut and the corner of the accommodation hole. Thus, for example, even if the radius of roundness of the corner of the nut is smaller than the radius of roundness of the corner of the accommodation hole, interference is restricted between the corner of the nut and the corner of the accommodation hole. This decreases the chips formed from scraping when the nut is press-fitted in the accommodation hole, and reduces a situation in which the chips collect on the bottom surface of the nut accommodation portion. Thus, the fastened nut positioning precision is maintained.

[2] Each of four sides defining a contour of the accommodation hole may include a first straight portion, two extensions, and a second straight portion. The first straight portion extends straight. The two extensions extend from two ends of the first straight portion toward the outer side of the through hole in directions that intersect the first straight portion. The second straight portion extends from an end of each of the extensions parallel to the first straight portion. The recessed portion is formed by the second straight portions and the extensions of two adjacent ones of the four sides.

With this structure, each recessed portion is formed by the extensions and the second straight portions of two adjacent ones of the four sides defining the contour of the accommodation hole. The recessed portions expand the space in the four corners of the through hole. Further, the second straight portion extends parallel to the first straight portion. This avoids enlargement of the contour of the accommodation hole.

[3] Length L1 of the first straight portion may be greater than length L2 of the extension and the second straight portion in a direction parallel to the first straight portion.

With this structure, the first straight portion, which forms an inner wall surface of the through hole, is longer than the extensions and the second straight portions, which form an inner wall surface of the recessed portions. This increases the length of abutment between the first straight portion and the corresponding side surface of the nut and increases the area of contact between the side surface of the nut and an inner wall surface of the accommodation hole. This avoids loosening of the nut in the nut accommodation portion.

[4] Length L1 of the first straight portion may be greater than length L3 that is a sum of two lengths L2. This structure increases the length of abutment between the first straight portion and the corresponding side surface of the nut. Thus, the area of contact is increased between the side surface of the nut and the inner wall surface of the accommodation hole, and loosening of the nut in the nut accommodation portion is avoided.

[5] Ratio L3/L1 of length L3 to length L1 may be in a range of 0.3 to 0.7.

When the ratio L3/L1 is too small, the formation range for the recessed portion will be small, and the corner of the nut will interfere with the corner of the recessed portion. When the ratio L3/L1 is too large, the first straight portion will be short, and an area of contact will decrease between the inner wall surface of the accommodation hole and the side surface of the nut. In this manner, when the ratio L3/L1 is too large, the nut will be loose in the nut accommodation portion.

With this respect, in the above structure, the ratio L3/L1 is set in a range of 0.3 to 0.7. This avoids loosening of the nut in the nut accommodation portion, and interference will be limited between the corners of the nut and the corners of the accommodation hole.

[6] An inner wall surface of the through hole forming the first straight portion may be flat. With this structure, the inner wall surface of the through hole, which abuts the side surfaces of the nut, is flat. This increases the area of contact between the side surfaces of the nut and the inner wall surface of the through hole. Thus, loosening of the nut in the nut accommodation portion is avoided.

[7] The connector may further include a nut cover that covers the nut accommodated in the nut accommodation portion. The nut cover restricts movement of the nut in a direction opposite to the press-fitting direction.

With this structure, the nut cover restricts the nut from moving in the direction opposite to the press-fitting direction. In this manner, the nut cover restricts movement of the nut in a direction extending away from the nut accommodation portion. This avoids separation of the nut from the nut accommodation portion.

[8] The connector housing may include a guide groove extending in a direction intersecting the press-fitting direction. The nut cover includes a rail portion slidable in the guide groove. The nut cover is a component separate from the connector housing.

In this structure, the nut cover and the connector housing are separate components. Thus, the nut cover can be coupled to the connector housing after the nuts are accommodated in the nut accommodation portions. Further, the nut cover can be coupled to the connector housing by sliding the rail portion of the nut cover in the guide groove of the connector housing. This facilitates coupling of the nut cover.

[9] The nut accommodation portion may include a plurality of nut accommodation portions. The plurality of the nut accommodation portions is covered by the same nut cover.

With this structure, the plurality of nut accommodation portions is covered with the same nut cover. This facilitates coupling of the nut cover as compared to when separate nut covers are coupled to the nut accommodation portions.

An example of a connector in accordance with the present disclosure will now be described with reference to the drawings. To facilitate understanding, configurations may be partially exaggerated or simplified in the drawings. Further, elements in the drawings may not be to scale. In the present specification, "parallel" and "orthogonal" include not only strictly parallel and strictly orthogonal cases but also include generally parallel and generally orthogonal cases within a range allowing the advantages of the present embodiment to be obtained. The present invention is not limited to the illustrated embodiments and intended to be defined by the claims and their equivalents, and all variations within the scope of the claims and their equivalents.

Entire Structure of Electroconductive Path 10

An electroconductive path 10 shown in FIG. 1 electrically connects two or more electric devices (devices). The electroconductive path 10 includes a wire harness 20 and two device-side connectors 30. The device-side connectors 30 are connected to two ends of the wire harness 20. The electroconductive path 10 electrically connects, for example, an inverter 11, which is arranged at the front of a vehicle such as a hybrid vehicle or an electric vehicle, and a high-voltage battery 12, which is installed closer to the rear of the vehicle than the inverter 11. The electroconductive path 10 is, for example, laid out under the floor of the vehicle. The inverter 11 is connected to a wheel driving motor (not shown) that serves as a power source for driving the vehicle. The inverter 11 generates alternating current from direct current of the high-voltage battery 12 and supplies the alternating current to the motor. The high-voltage battery 12 is, for example, a battery capable of supplying several hundred volts.

Structure of Wire Harness 20

The wire harness 20 includes multiple (two in present embodiment) wires 21, two wire-side connectors 22, and a protective tube 23. The wire-side connectors 22 are attached to two ends of the wires 21. The protective tube 23 encloses all of the wires 21. One of the wire-side connectors 22 is connected to the device-side connector 30 that is coupled to the inverter 11, and the other one of the wire-side connectors 22 is connected to the device-side connector 30 that is coupled to the high-voltage battery 12. The protective tube 23 may be, for example, a metal or synthetic resin pipe, a flexible corrugated tube formed from synthetic resin or the like, a waterproof rubber cover, or a combination of these parts. The protective tube 23, for example, protects the accommodated wires 21 from flying objects and liquid.

Each connector 30 is fastened to an electrically conductive case 15 of an electric device such as the inverter 11 or the high-voltage battery 12. Each wire-side connector 22 is fitted to the corresponding connector 30 and electrically connected with the connector 30. The material of the case 15 may be, for example, a metal material such as an iron-based metal or an aluminum-based metal.

Structure of Case 15

Figure 2:
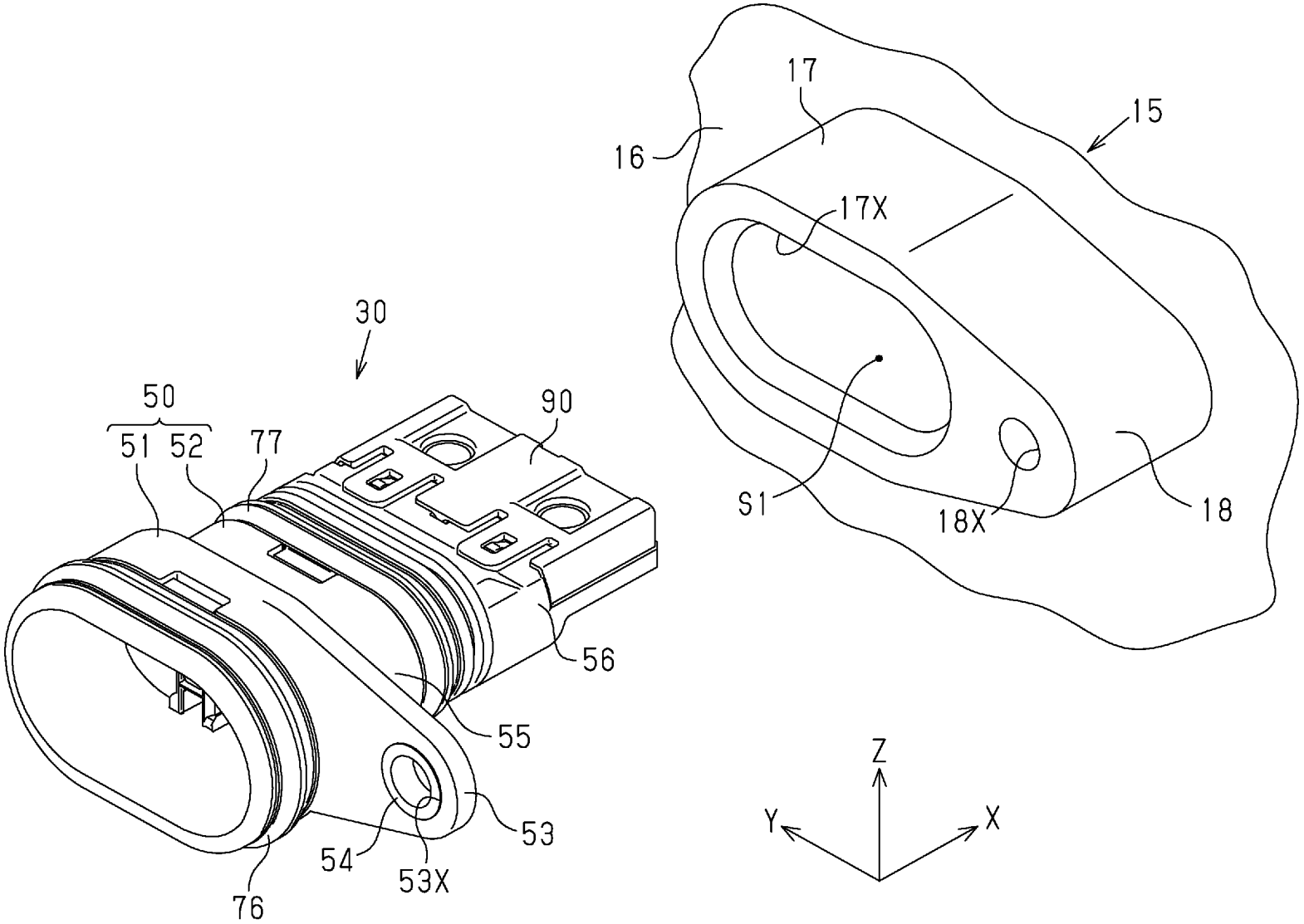
FIG. 2 is a schematic perspective view showing a connector of the embodiment.

As shown in FIG. 2, the case 15 includes a box-shaped case body 16 and a tubular attachment portion 17. The attachment portion 17 is arranged integrally with the case body 16 and projected out of the case body 16. The attachment portion 17 is tubular and includes an attachment hole 17*x* extending through the attachment portion 17. The attachment hole 17*x* connects an interior S1 of the case body 16 and an exterior of the case body 16. The attachment hole 17*x* has, for example, an elongated shape as viewed in a hole-extending direction and includes a long side and a short side. In the present specification, "elongated shape" includes, for example, a rectangle, an ellipse, an oval, and the like. In the present specification, "rectangle" includes a shape having long sides and short sides and does not include a square. Further, "rectangular" in the present specification includes a shape in which corners are chamfered or rounded. In the present specification, "ellipse" is a shape formed by two parallel lines having substantially the same length and two semicircles. The attachment hole 17*x* in the present embodiment has an elliptic shape as viewed in the hole-extending direction. Further, the attachment portion 17 in the present embodiment is shaped to be a substantially elliptic tube.

The connector 30 can be attached to the case 15 in any direction in accordance with the position of the attachment portion 17. In the present embodiment, the structure of the connector 30 is described referring to the hole-extending direction of the attachment hole 17*x* as a front-rear direction. As for the X-, Y-, and Z-axes in the drawings, the X-axis indicates a front-rear direction of the connector 30, the Y-axis indicates a sideward direction (widthwise direction) of the connector 30 that is orthogonal to the X-axis, and the Z-axis indicates a vertical direction (height direction) of the connector 30 that is orthogonal to an XY-plane. In the description hereafter, to facilitate understanding, a direction extending in the X-axis will be referred to as the front-rear direction X, a direction extending in the Y-axis will be referred to as the sideward direction Y, and a direction extending in the Z-axis will be referred to as the vertical direction Z. Further, in the description hereafter, in FIG. 2, arrow X indicates the frontward direction, arrow Y indicates the leftward direction, and arrow Z indicates the upward direction.

The case 15 includes a fastening portion 18 that fastens the connector 30 to the case 15. The fastening portion 18, for example, projects out of the case body 16. The fastening portion 18 is formed, for example, integrally with the attachment portion 17. The fastening portion 18 is arranged, for example, next to the attachment portion 17 in the sideward direction Y. The fastening portion 18 in the present embodiment is arranged at the right side of the attachment portion 17. The fastening portion 18 includes a bolt fastening hole 18X. The bolt fastening hole 18X extends, for example, in the front-rear direction X.

Structure of Connector 30

Figure 3:
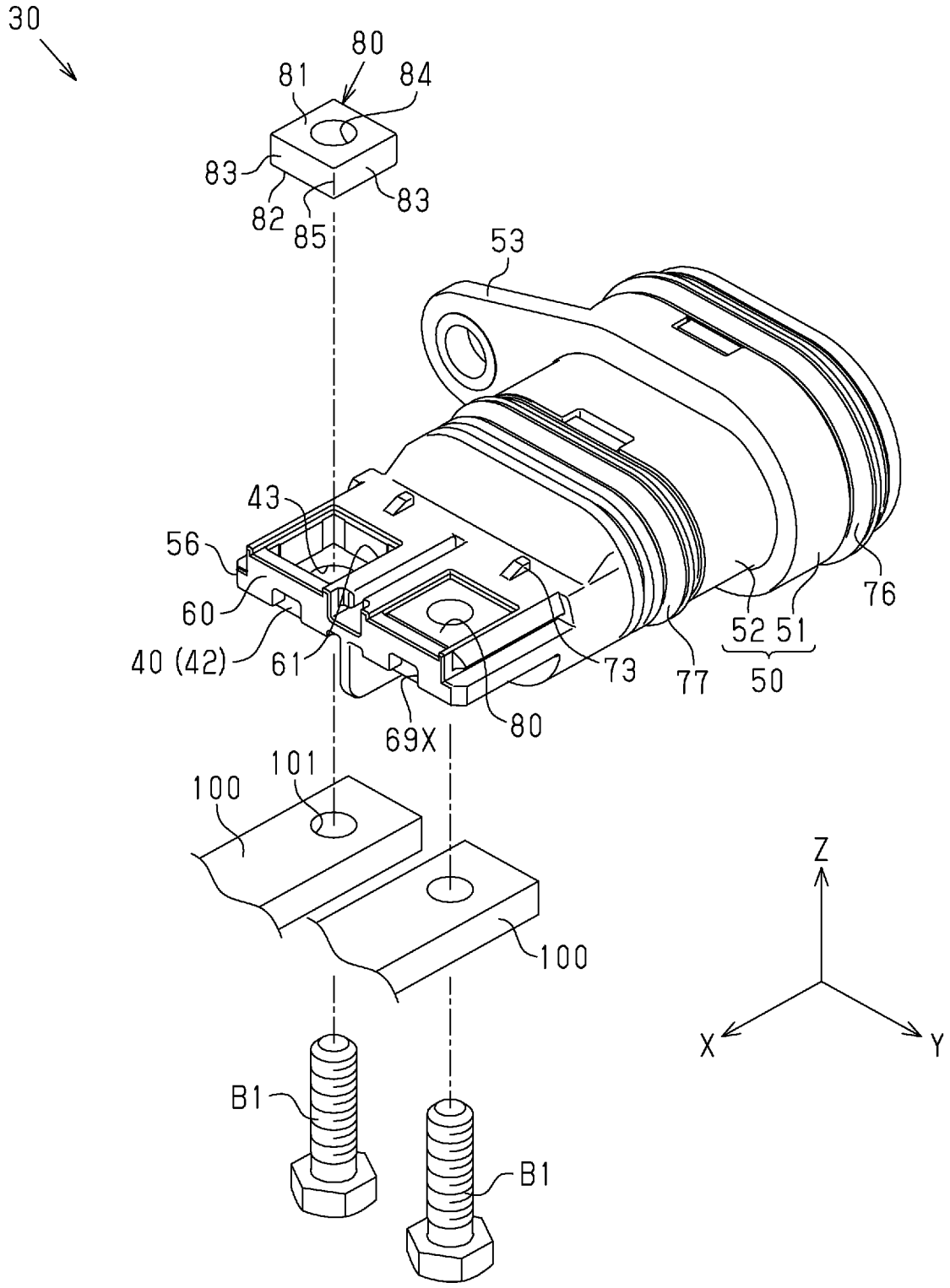
FIG. 3 is a schematic exploded perspective view showing the connector of the embodiment.
Figure 4:
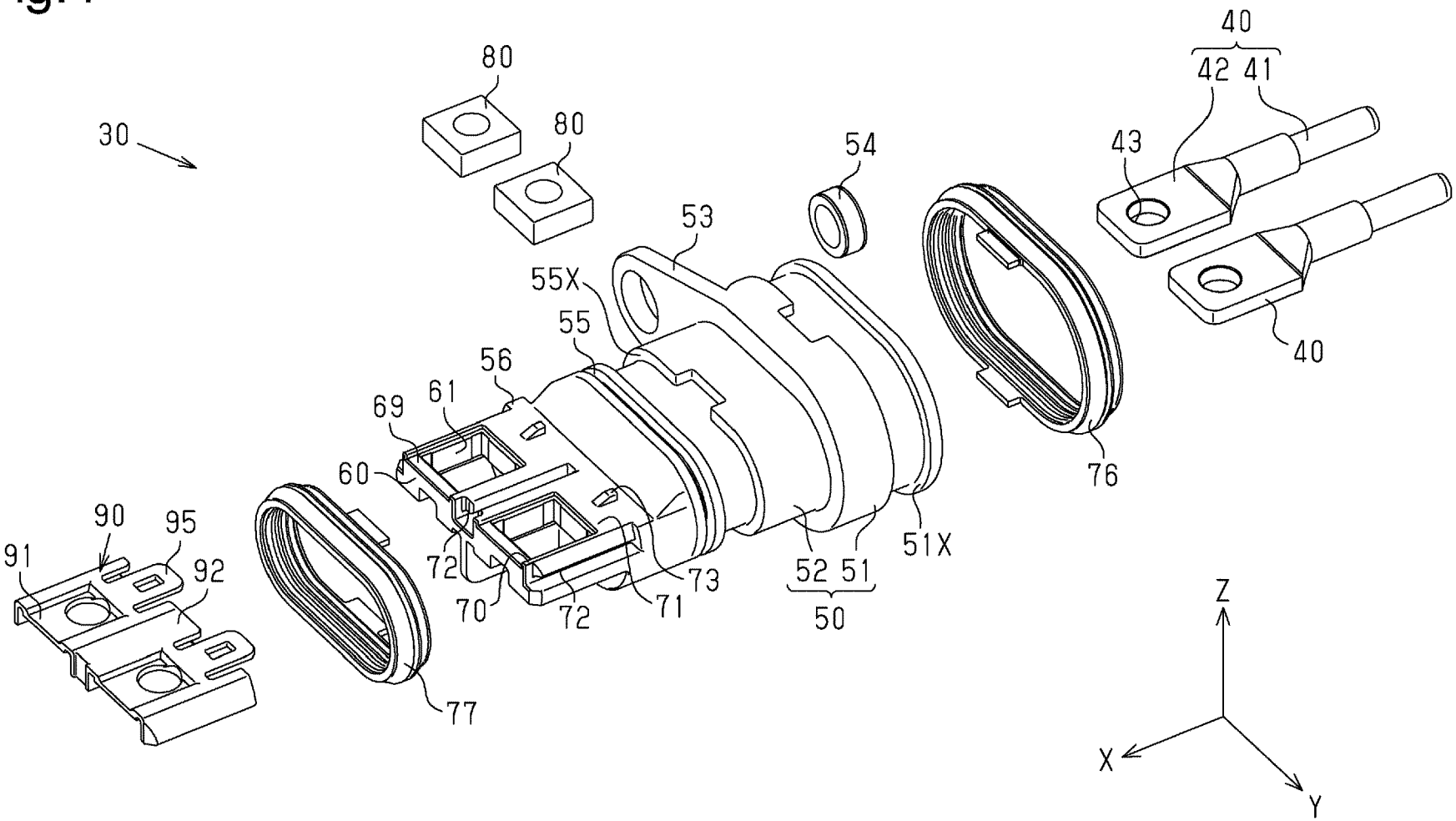
FIG. 4 is a schematic exploded perspective view showing the connector of the embodiment.

As shown in FIGS. 3 and 4, the connector 30 includes multiple (two in present embodiment) metal connection terminals 40, a connector housing 50, a rubber ring 76, and a rubber ring 77. The connection terminals 40 are attached to the connector housing 50, and the rubber ring 76 and the rubber ring 77 are coupled to an outer surface of the connector housing 50. As shown in FIG. 4, the connector 30 includes multiple (two in present embodiment) nuts 80 and a nut cover 90.

Structure of Connection Terminal 40

Each connection terminal 40 includes a male terminal portion 41 and a terminal connection portion 42. Each connection terminal 40 is, for example, a single component in which the male terminal portion 41 and the terminal connection portion 42 are formed continuously and integrally with each other in the front-rear direction X. The material of the connection terminal 40 can be, for example, a metal material such as copper, copper alloy, aluminum alloy, or stainless steel. In accordance with the type of the metal composing the connection terminal 40 and the environment in which the connection terminal 40 is used, the connection terminal 40 may undergo a surface treatment such as silver plating, tin plating, or aluminum plating.

The male terminal portion 41 is formed, for example, to be cylindrical. The male terminal portion 41, for example, extends from the terminal connection portion 42 toward the rear. The male terminal portion 41 is, for example, electrically connected to the wire 21 via a female terminal (not shown) arranged in the wire-side connector 22 shown in FIG. 1.

The terminal connection portion 42 is shaped, for example, to be a flat plate. The terminal connection portion 42, for example, extends from the male terminal portion 41 toward the front. The terminal connection portion 42 includes a through hole 43 extending through the terminal connection portion 42 in a plate thickness direction (here, vertical direction Z). The through hole 43 has, for example, a circular shape as viewed in a hole-extending direction (here, vertical direction Z).

As shown in FIG. 3, the terminal connection portion 42 is, for example, electrically connected to a mate terminal 100 in the interior S1 in the case body 16 (refer to FIG. 2). The mate terminal 100 is, for example, a connection terminal of an electric device such as the inverter 11 or the high-voltage battery 12 shown in FIG. 1. The mate terminal 100 is, for example, a flat bus bar. The mate terminal 100 includes, for example, a through hole 101 extending through the mate terminal 100 in a plate thickness direction (here, vertical direction Z). The through hole 101 has, for example, a circular shape as viewed in a hole-extending direction (here, vertical direction Z). Each connection terminal 40 is connected to the corresponding mate terminal 100 by fastening a bolt B1 and the nut 80. Specifically, the terminal connection portion 42 is disposed on an upper surface of the mate terminal 100 so that the through hole 43 of the terminal connection portion 42 overlaps the through hole 101 of the mate terminal 100 in the vertical direction Z. The terminal connection portion 42 is connected with the mate terminal 100 by fastening the nut 80 to a shaft of the bolt B1, which is inserted through the through hole 43 and the through hole 101. This electrically connects the connection terminal 40 and the mate terminal 100. The material of the mate terminal 100 can be, for example, a metal material such as copper, copper alloy, aluminum alloy, or stainless steel. In accordance with the type of the metal composing the mate terminal 100 or the environment in which the mate terminal 100 is used, the mate terminal 100 may undergo a surface treatment such as silver plating, tin plating, or aluminum plating.

Structure of Connector Housing 50

As shown in FIG. 2, the connector housing 50 is, for example, substantially tubular and extends in the front-rear direction X. The connector housing 50 is formed, for example, to have an elongated shape that is longer in the sideward direction Y than in the vertical direction Z. The connector housing 50 includes a hood portion 51 and an insertion portion 52. The hood portion 51 is arranged outside the case 15, and the insertion portion 52 is inserted in the attachment hole 17*x* of the case 15. The connector housing 50 is, for example, a single component including the hood portion 51 and the insertion portion 52 that are continuously and integrally formed with each other in the front-rear direction X. The material of the connector housing 50 may be, for example, an insulative material such as synthetic resin.

Structure of Hood Portion 51

The hood portion 51 is formed, for example, to have an elongated shape that is longer in the sideward direction Y than in the vertical direction Z. The hood portion 51 is formed, for example, to be tubular and extends in the front-rear direction. Further, the hood portion 51 is formed to have an elliptic contour. The hood portion 51 of the present embodiment is shaped to have the form of an elliptic tube. A fastening portion 53 extends radially outward from the outer surface of the front end of the hood portion 51. The fastening portion 53 is formed, for example, to be substantially plate-like. The fastening portion 53 includes a bolt insertion hole 53X extending through the fastening portion 53 in a plate thickness direction (here, front-rear direction X).

Figure 5:
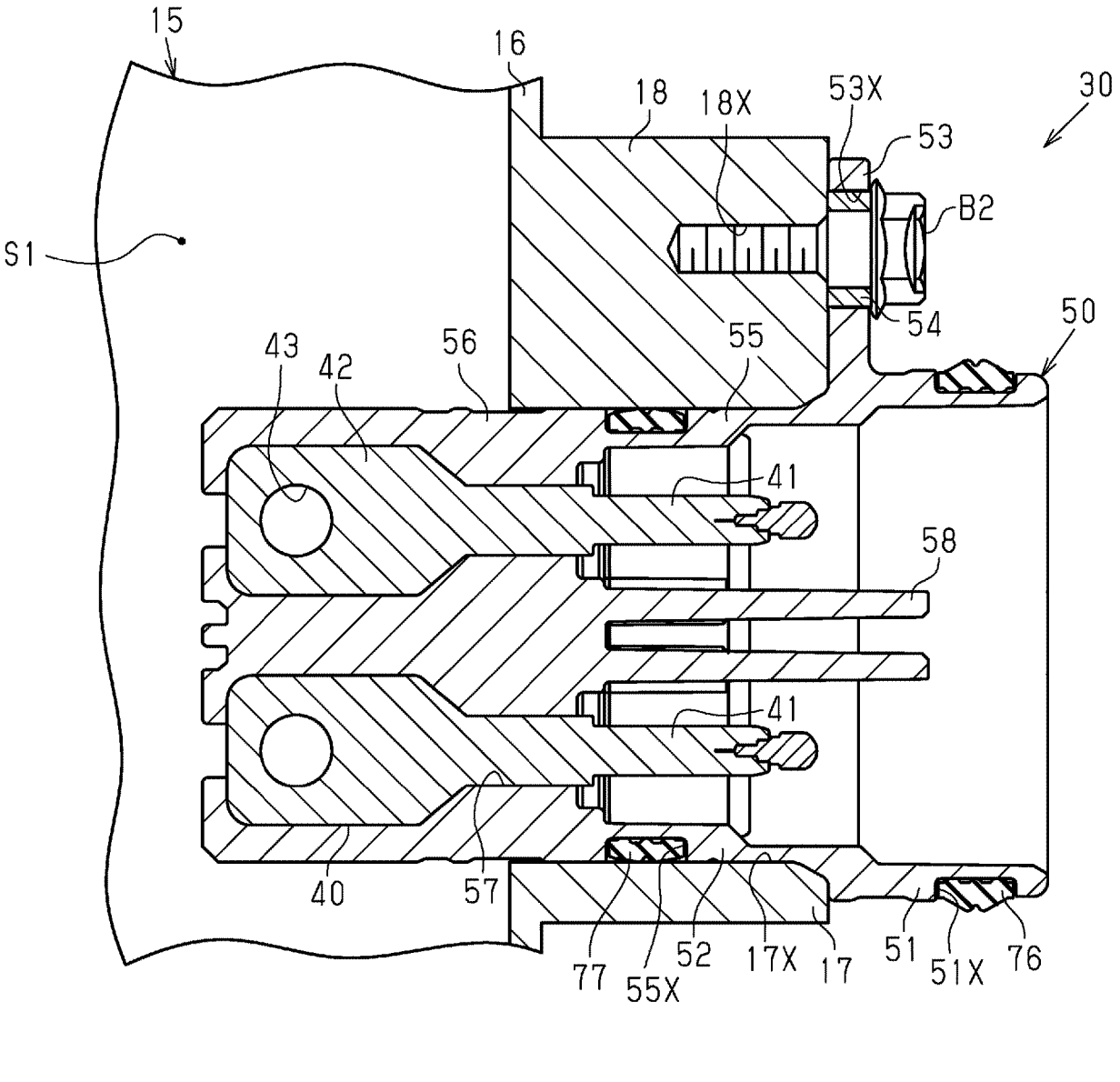
FIG. 5 is a schematic cross-sectional view showing the connector of the embodiment.
Figure 5:
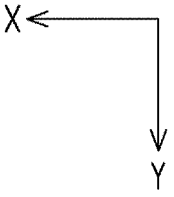

As shown in FIG. 5, a metal collar 54 is coupled to the bolt insertion hole 53X to allow for insertion of a fastening bolt B2. The connector housing 50 is fixed to the case 15 by fastening the fastening bolt B2 through the bolt insertion hole 53X of the fastening portion 53 to the bolt fastening hole 18X, which is arranged in the fastening portion 18 of the case 15. Thus, the fastening portion 53 of the connector housing 50 is arranged outside the case 15.

In an example, an accommodation groove 51X that accommodates the rubber ring 76 is formed in the outer surface of the hood portion 51 at the rear of the fastening portion 53. The accommodation groove 51X is formed, for example, over the entire outer surface in a looped direction of the hood portion 51. The rubber ring 76 is fitted in the accommodation groove 51X. In an example, when the connector 30 and the wire-side connector 22 (refer to FIG. 1) are fitted together, the rubber ring 76 abuts the entire inner surface of a metal shield shell of the wire-side connector 22 in the looped direction and prevents water from entering the gap between the outer surface of the hood portion 51 and the inner surface of the wire-side connector 22.

Structure of Insertion Portion 52

The insertion portion 52 is formed, for example, to project toward the front from the front end of the hood portion 51. The insertion portion 52 includes a tubular portion 55 and a terminal holding portion 56, which projects toward the front from the tubular portion 55.

Structure of Tubular Portion 55

The tubular portion 55 is formed, for example, to be tubular and includes an outer surface shaped in correspondence with an inner surface of the attachment hole 17*x*. The tubular portion 55 is formed, for example, to be tubular and extends in the front-rear direction. Further, the tubular portion 55 is formed to have an elliptic contour. The tubular portion 55 of the present embodiment is shaped to be an elliptic tube.

An accommodation groove 55X that accommodates the rubber ring 77 is formed, for example, in the outer surface of the tubular portion 55. The accommodation groove 55X is formed, for example, over the entire outer surface in the lopped direction of the tubular portion 55. The rubber ring 77 is fitted in the accommodation groove 55X. When the insertion portion 52 is fitted in the attachment hole 17*x*, the rubber ring 77 abuts the entire inner surface of the attachment hole 17*x* in the looped direction and prevents water from entering the gap between the outer surface of the connector housing 50 and the inner surface of the case 15.

Structure of Terminal Holding Portion 56

The terminal holding portion 56 is arranged, for example, on an end wall of the tubular portion 55. The terminal holding portion 56, for example, projects toward the front from the end wall of the tubular portion 55. The terminal holding portion 56 partially or entirely projects toward the front from the attachment hole 17*x* into the interior S1 of the case 15. The terminal holding portion 56 includes, for example, multiple (here, two) holding holes 57 formed next to each other in the sideward direction Y. Each holding hole 57, for example, extends through the terminal holding portion 56 in the front-rear direction X. For example, each connection terminal 40 is held in the corresponding holding hole 57. In the connector 30, for example, the connection terminals 40 are integrated with the terminal holding portion 56. For example, each connection terminal 40 is integrally attached to the terminal holding portion 56 by insert molding or the like.

The male terminal portion 41 of each connection terminal 40 projects rearward from the end wall of the tubular portion 55 toward the hood portion 51. Each male terminal portion 41, for example, extends to the vicinity of the rear end of the tubular portion 55. For example, a partition wall 58 is formed between the male terminal portions 41. The partition wall 58 is arranged, for example, between the two male terminal portions 41, which are arranged next to each other in the sideward direction Y. The partition wall 58 projects toward the rear from the end wall of the tubular portion 55 in the front-rear direction X. The partition wall 58, for example, extends into the interior of the hood portion 51.

As shown in FIG. 3, the connector 30 includes multiple nut accommodation portions 60, in which the nuts 80 are press-fitted and accommodated in a press-fitting direction (here, vertical direction Z). The nut accommodation portions 60 are, for example, spaced apart from each other in the sideward direction Y.

Structure of Nut 80

Each nut 80 has the form of a square post. Each nut 80 includes an upper surface 81, a lower surface 82, and four side surfaces 83. The upper surface 81 is located at a side opposite to the lower surface 82, and the side surfaces 83 are located between the upper surface 81 and the lower surface 82. The nut 80 includes a through hole 84 extending through the nut 80 in the press-fitting direction (here, vertical direction Z). The through hole 84, for example, extends from the upper surface 81 to the lower surface 82. The through hole 84 is formed, for example, to have a circular shape as viewed in the press-fitting direction of the nut 80. The through hole 84 is formed, for example, in a central part of the upper surface 81. For example, in a state in which the nut 80 is accommodated in the nut accommodation portion 60, the through hole 84 is configured to overlap the through hole 43 of the terminal connection portion 42 in the vertical direction Z.

The nut 80 is formed to have a tetragonal planar shape as viewed in the press-fitting direction of the nut 80 (here, vertical direction Z). The nut 80 of the present embodiment is formed so that the planar shape as viewed in the press-fitting direction of the nut 80 is square. That is, in the present embodiment, the upper surface 81 and the lower surface 82 of the nut 80 are formed to be square. Each side surface 83 extends in the press-fitting direction of the nut 80. Corners 85 located between two adjacent side surfaces 83, that is, the four corners 85 of the nut 80, are substantially angled corners. For example, each corner 85 has a roundness of which radius R is small. For example, the radius R of the corner 85 is 0.3 mm or less. The nut 80 is, for example, an article manufactured by forging. When the nut 80 is such a forged article, the radius R of the corner 85 is, for example, 0.2 mm or less.

Structure of Nut Accommodation Portion 60

Each nut accommodation portion 60 includes an accommodation hole 61 extending through the terminal holding portion 56 in the press-fitting direction of the nut 80 (here, vertical direction Z) and an end surface (here, upper surface) of the connection terminal 40 exposed from the accommodation hole 61. The accommodation hole 61 is formed, for example, in the terminal holding portion 56 of the connector housing 50. The through hole 43 of the terminal connection portion 42 is exposed from the accommodation hole 61. The accommodation hole 61 includes an inner wall surface, for example, projecting upward from the upper surface of the terminal connection portion 42. For example, the inner wall surface of the accommodation hole 61 continuously rises upward from the upper surface of the terminal connection portion 42. For example, the inner wall surface of the accommodation hole 61 is integrated with the upper surface of the terminal connection portion 42. Further, each nut accommodation portion 60 is configured by the inner wall surface of the accommodation hole 61 and the upper surface of the terminal connection portion 42, which is exposed from the accommodation hole 61. Thus, the upper surface of the terminal connection portion 42 exposed from the accommodation hole 61 forms a bottom surface of the nut accommodation portion 60. The accommodation hole 61 has a depth that is, for example, set to be substantially the same as the height of the nut 80 in the vertical direction Z.

Figure 6A:
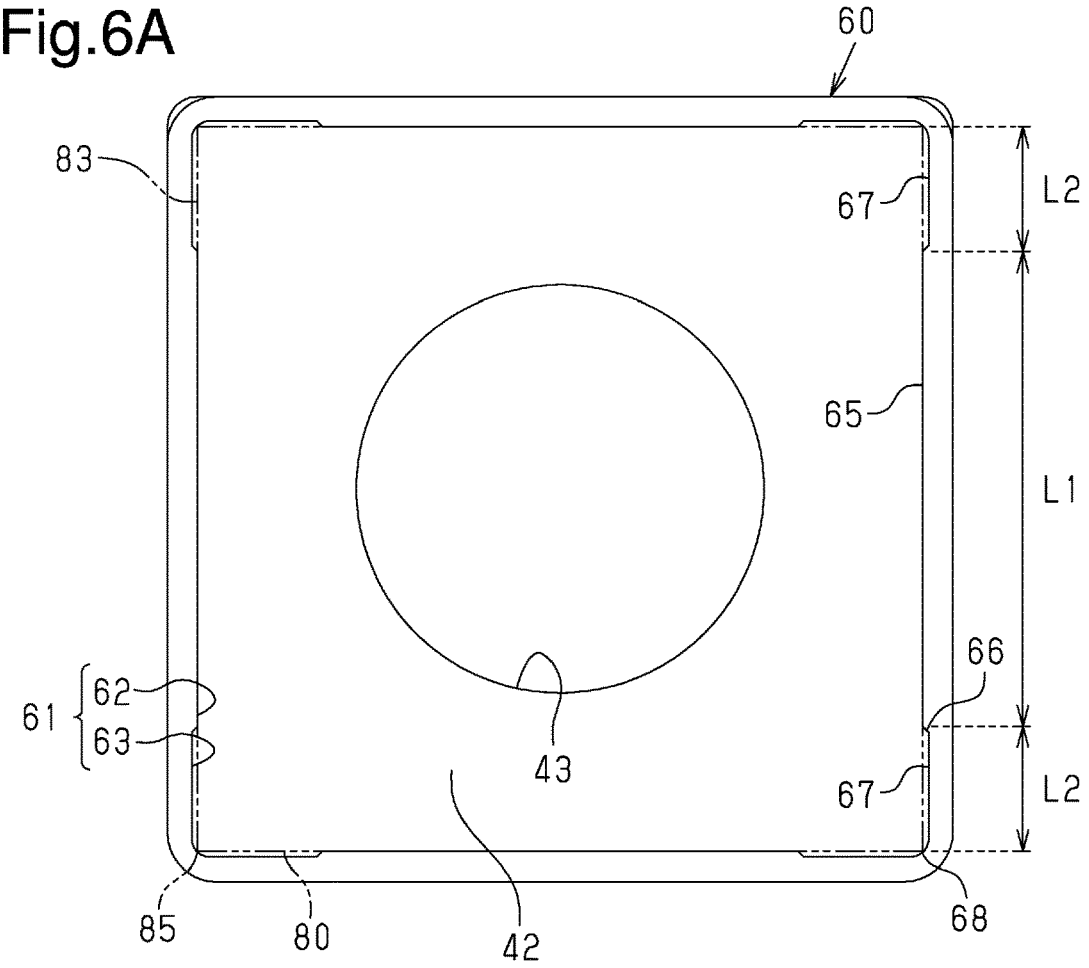
FIG. 6A is a schematic plan view showing a nut accommodation portion of the embodiment.

As shown in FIG. 6A, the accommodation hole 61 includes a through hole 62 and recessed portions 63. The planar shape of the through hole 62 is tetragonal as viewed in the press-fitting direction of the nut 80. The recessed portions 63 are formed in the four corners of the through hole 62.

The through hole 62 is formed to have, for example, a tetragonal planar shape as viewed in the press-fitting direction of the nut 80. The planar shape of the through hole 62 has substantially the same size as the nut 80.

Each recessed portion 63 is recessed outward from the through hole 62 to locally expand the contour of the through hole 62. The recessed portions 63 are formed only in the corners of the through hole 62.

Figure 6B:
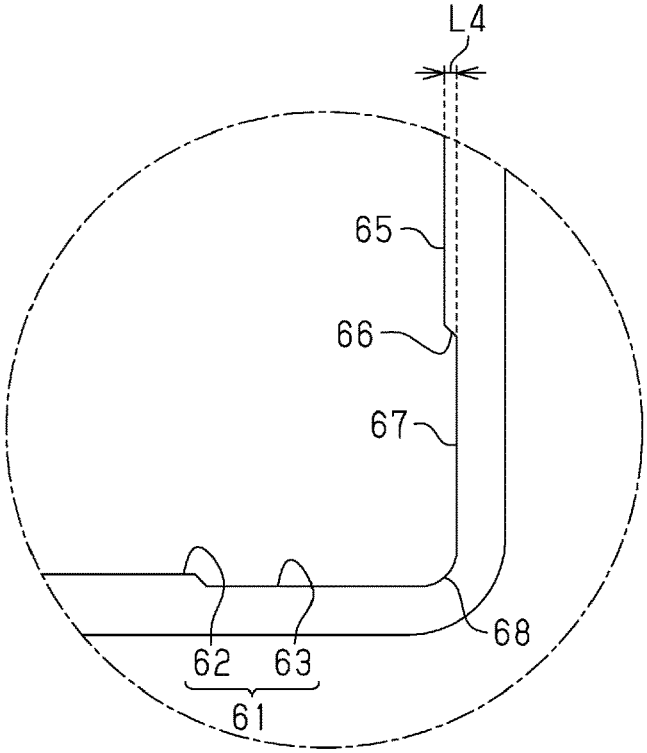
FIG. 6B is a partially enlarged plan view showing the nut accommodation portion of the embodiment.

As shown in FIGS. 6A and 6B, each of the four sides defining the accommodation hole 61 includes a straight portion 65, two extensions 66, and a straight portion 67. The straight portion 65 extends straight. The extensions 66 respectively extend from two ends of the straight portion 65 toward the outer side of the through hole 62 in directions intersecting the straight portion 65. The straight portion 67 extends from each extension 66 parallel to the straight portion 65.

The straight portions 65 form the inner wall surface of the through hole 62. The straight portion 65, for example, extends straight in a looped direction, which is the direction in which the entire inner wall surface of the through hole 62 extends. As shown in FIG. 6A, in a state in which the nut 80 is accommodated in the nut accommodation portion 60, the side surfaces 83 of the nut 80 abut the inner wall surface of the through hole 62, which forms the straight portion 65.

The extensions 66 and the straight portions 67 form an inner wall surface of the recessed portion 63. The extensions 66, for example, extend in directions intersecting the looped direction of the through hole 62. The straight portions 67, for example, extend straight parallel to the looped direction of the through hole 62.

Each recessed portion 63 is formed by the extensions 66 and the straight portions 67 of two adjacent ones of the four sides defining the accommodation hole 61. In each recessed portion 63, the ends of the two adjacent straight portions 67 are connected to each other. The portion at which the ends of two straight portions 67 are connected forms a corner 68 of the recessed portion 63. The radius R of the roundness of the corner 68 is, for example, greater than the radius R of the roundness of the corner 85 of the nut 80. The radius R of the corner 68 may be, for example, approximately 0.3 mm to 0.6 mm.

Length L1 of the straight portion 65 is set, for example, to be greater than length L2 of the extension 66 and the straight portion 67, which extends in a direction parallel to the straight portion 65. That is, length L1 of the straight portion 65 is set to be greater than length L2 of the extension 66 and the straight portion 67, which extends in a direction parallel to the looped direction of the through hole 62. Length L1 of the straight portion 65 is set, for example, to be greater than length L3 (=L2×2), which is the sum of two lengths L2. That is, length L1 of the straight portion 65 is set to be greater than the total length of two sets of the extension 66 and the straight portion 67 in each side of the accommodation hole 61. Preferably, a ratio L3/L1 of length L3 to length L1 is in a range of 0.3 to 0.7, further preferably in a range of 0.4 to 0.6, and even further preferably in a range of 0.4 to 0.5. When the ratio L3/L1 is too small, the formation range of the recessed portion 63 will be small, and the corner 85 of the nut 80 will interfere with the corner 68 of the recessed portion 63. When the ratio L3/L1 is too large, the straight portion 65 will be short, and the area of contact will decrease between the inner wall surface of the accommodation hole 61 and the side surface 83 of the nut 80. In this manner, when the ratio L3/L1 is too large, the nut 80 will be loose in the nut accommodation portion 60. In comparison, when the ratio L3/L1 is set in a range of 0.3 to 0.7, the nut 80 will not be loose in the nut accommodation portion 60, and interference will be limited between the corners 85 of the nut 80 and the corners 68 of the recessed portion 63. Length L1 of the straight portion 65 may be, for example, approximately 7 mm to 9 mm. Length L2 may be, for example, approximately 1.5 mm to 3 mm.

As shown in FIG. 6B, distance L4 between the straight portion 65 and the straight portion 67 may be, for example, approximately 0.1 mm to 0.2 mm. Distance L4, for example, corresponds to a recessed amount of the recessed portion 63. For example, distance L4 corresponding to the recessed amount of the recessed portion 63 is set so that even when the corners 85 of the nut 80 are angled corners, the corners 85 of the nut 80 will not interfere with the corners 68 of the recessed portion 63.

Figure 7:
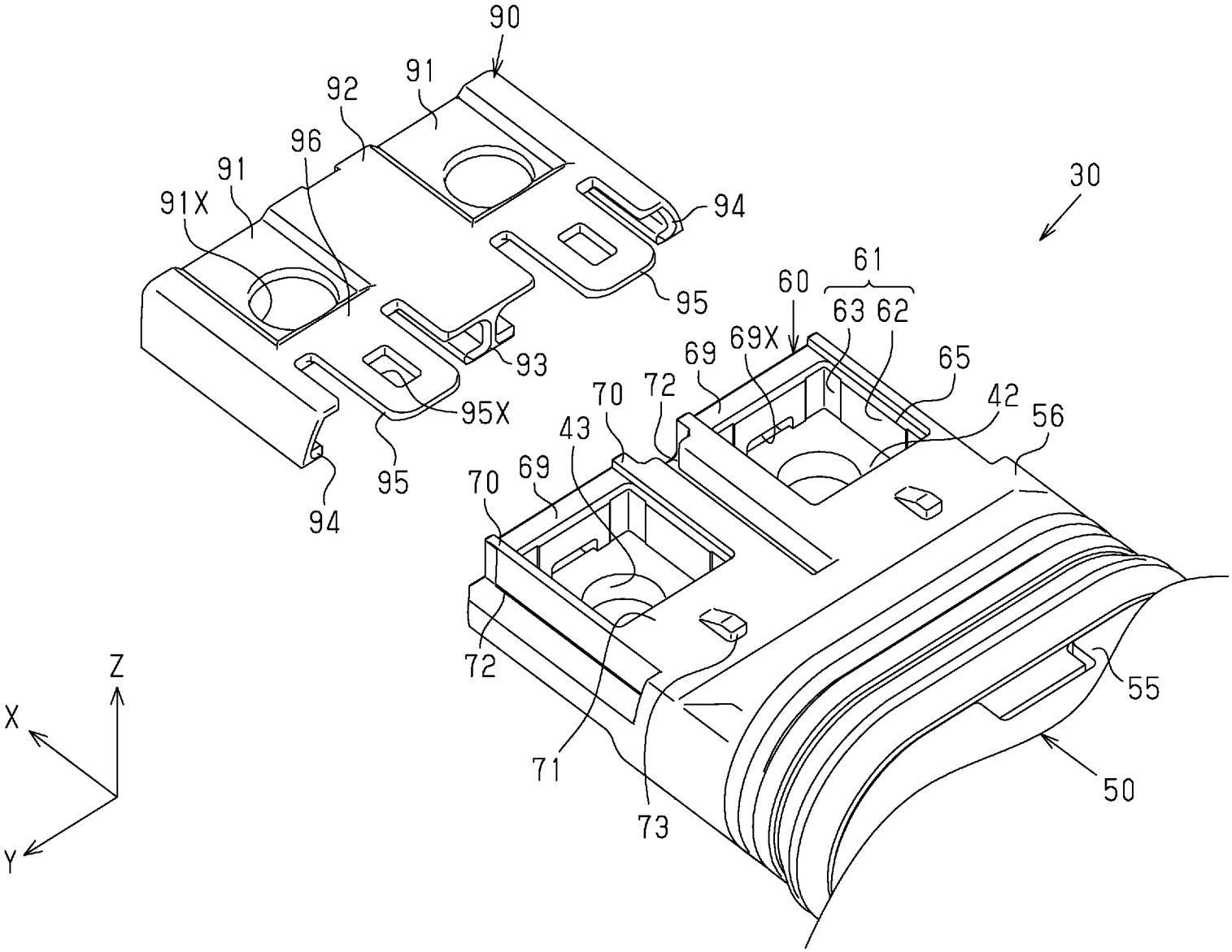
FIG. 7 is a schematic exploded perspective view showing part of the connector of the embodiment.

As shown in FIG. 7, the inner wall surface of the through hole 62 forming the straight portion 65 is, for example, flat. That is, the inner wall surface of the through hole 62 does not include a rib or a projection. In the same manner, the inner wall surface of the recessed portion 63 is, for example, flat.

Among wall portions forming the inner wall surface of the accommodation hole 61, a front wall 69 is located at the front and includes a hole 69X extending through the front wall 69 in the front-rear direction X. The hole 69X is, for example, formed in a lower end of the inner wall surface of the through hole 62. The hole 69X, for example, exposes part of the upper surface of the terminal connection portion 42. The hole 69X, for example, connects the inside and outside of the nut accommodation portion 60. The hole 69X functions, for example, as a hole that releases chips from scraping, which may be formed when the nut 80 (refer to FIG. 3) is press-fitted to the nut accommodation portion 60, to the outside.

Coupling Structure for Nut Cover 90

As shown in FIGS. 4 and 7, the connector housing 50 (terminal holding portion 56) includes a pair of side walls 70 and a connecting wall 71. The side walls are located at each of the two sides of the nut accommodation portion 60 in the sideward direction Y. The connecting wall 71 connects the two side walls 70 at the rear of the nut accommodation portion 60. Each side wall 70, for example, extends in the front-rear direction X. The connecting wall 71, for example, extends between the two side walls 70 in the sideward direction Y. Upper surfaces of the side walls 70 and an upper surface of the connecting wall 71, for example, project further upward from an upper surface of the nut accommodation portion 60. For example, the upper surfaces of the side walls 70 and the upper surface of the connecting wall 71 project further upward from an upper surface of the front wall 69 of the nut accommodation portion 60.

Each side wall 70 includes, for example, guide grooves 72. Each guide groove 72 is formed in, for example, the surface faced away from the nut accommodation portion 60. Each guide groove 72, for example, extends in the front-rear direction X, which intersects the press-fitting direction of the nut 80. The two side walls 70 between the two adjacent nut accommodation portions 60 are, for example, separated from each other in the sideward direction Y. The opposed surfaces of the two side walls 70 each include the guide groove 72.

A lock protrusion 73 may be formed on the upper surface of each connecting wall 71. The lock protrusion 73, for example, protrudes upward from the upper surface of the corresponding connecting wall 71.

Structure of Nut Cover 90

The nut cover 90 will now be described.

As shown in FIG. 4, the nut cover 90 is, for example, a component separate from the connector housing 50. The nut cover 90 is coupled to the connector housing 50, for example, in a state in which the nuts 80 are press-fitted and accommodated in the nut accommodation portions 60. The nut cover 90 restricts movement of the nuts 80, which are accommodated in the nut accommodation portions 60, in a direction opposite to the press-fitting direction of the nuts 80 (here, vertical direction Z).

As shown in FIG. 7, the nut cover 90 includes multiple (two in present embodiment) cover portions 91 and a coupling portion 92 that couples the cover portions 91. The nut cover 90 includes a rail portion 93, rail portions 94, and lock frames 95. The rail portion 93 is formed on a lower surface of the coupling portion 92, and the rail portions 94 are formed at an outer side of each cover portion 91 in the sideward direction Y. The lock frames 95 project toward the rear from each cover portion 91. The nut cover 90 of the present embodiment is a single component integrating the cover portions 91, the coupling portion 92, the rail portion 93, the rail portions 94, and the lock frames 95.

Each cover portion 91 is shaped to be, for example, a flat plate. The cover portion 91 is formed, for example, at a position located downward from the coupling portion 92. For example, an upper surface of the cover portion 91 is located downward from an upper surface of the coupling portion 92. For example, a lower surface of the cover portion 91 is located downward from a lower surface of the coupling portion 92. The cover portion 91 includes a through hole 91X extending through the cover portion 91 in the vertical direction Z. The through hole 91X is formed, for example, to have a circular planar shape as viewed in the vertical direction Z.

In a state in which the nut cover 90 is coupled to the connector housing 50, the cover portions 91 are arranged to close open parts of the nut accommodation portions 60. In this case, the lower surfaces of the cover portions 91, for example, come into contact with the upper surfaces of the front walls 69. Further, the cover portions 91 are disposed, for example, between the two side walls 70. Also, the through hole 91X is disposed to overlap the through hole 43 of the terminal connection portion 42 in the vertical direction Z.

The coupling portion 92 is located between the cover portions 91. The coupling portion 92 is, for example, continuously integrated with the cover portions 91. The coupling portion 92, for example, extends in the front-rear direction X over the entire length of the cover portion 91 in the front-rear direction X. Moreover, the coupling portion 92, for example, projects further rearward from rear ends of the cover portions 91.

The rail portion 93, for example, extends over the entire length of the coupling portions 92 in the front-rear direction X. The rail portion 93 is, for example, configured to be slidable in the two guide grooves 72 between the two adjacent nut accommodation portions 60.

Each rail portion 94, for example, is located at an outer side of the corresponding cover portion 91 in the sideward direction Y. An upper surface of each rail portion 94 is, for example, located further upward from the upper surface of the cover portion 91. The upper surface of each rail portion 94 is, for example, flush with the upper surface of the coupling portion 92. Each rail portion 94, for example, extends in the front-rear direction X over the entire length of the cover portions 91 in the front-rear direction X. Moreover, each rail portion 94, for example, projects further rearward from the rear end of the cover portion 91. Each rail portion 94 is configured to be slidable, for example, in the guide groove 72, which is located at the outer side of the corresponding nut accommodation portion 60 in the sideward direction Y.

Each lock frame 95, for example, projects rearward from a rear end of a connecting portion 96 that is connected to the rear end of the corresponding cover portion 91. An upper surface of the connecting portion 96 and an upper surface of the lock frame 95 are, for example, located further upward from the upper surface of the cover portion 91. The upper surface of the connecting portion 96 and the upper surface of the lock frame 95 are, for example, flush with the upper surface of the coupling portion 92 and the upper surface of the rail portion 94. Each lock frame 95 is, for example, a cantilever having a fixed proximal end that is connected with the connecting portion 96 and a free distal end located at a side opposite to the proximal end. Each lock frame 95 is, for example, bendable in the vertical direction Z when elastically deformed.

The lock frame 95 includes an engagement hole 95X that is engageable with the corresponding lock protrusion 73 of the connector housing 50. The engagement hole 95X, for example, extends through the lock frame 95 in the vertical direction Z. The engagement hole 95X has, for example, a tetragonal planar shape as viewed in the vertical direction Z.

The nut cover 90 can be coupled to the connector housing 50, for example, by sliding the nut cover 90 relative to the connector housing 50 from the front in the front-rear direction X. In this case, the nut cover 90 can be moved in the front-rear direction X while sliding the rail portions 93 and 94 in the guide grooves 72 of the connector housing 50. When the nut cover 90 is coupled to the connector housing 50, each lock protrusion 73 is engaged with the corresponding engagement hole 95X of the lock frame 95. This maintains the nut cover 90 in a closed state in which the open parts of the nut accommodation portions 60 are closed by the cover portions 91. In the closed state, the cover portions 91 cover the upper sides of the nuts 80 (refer to FIG. 3). This restricts movement of the nuts 80 in the vertical direction Z. The bolts B1 and the nuts 80 shown in FIG. 3 are fastened together in the closed state. Thus, movement of each nut 80 in the vertical direction Z is restricted when fastening the bolt B1 to the nut 80. In the present embodiment, the two nut accommodation portions 60 are both closed with the same nut cover 90. This facilitates coupling of the nut cover 90 as compared with when coupling separate nut covers 90 to the nut accommodation portions 60.

The advantages of the present embodiment will now be described.

(1) The connector 30 includes the nut accommodation portions 60 in which the nuts 80 are press-fitted and accommodated in a press-fitting direction. Each nut accommodation portion 60 includes the accommodation hole 61, which extends through the connector housing 50 in the press-fitting direction of the nut 80, and the upper surface of the terminal connection portion 42 of the corresponding connection terminal 40, which is exposed from the accommodation hole 61. The accommodation hole 61 includes the through hole 62, which has a tetragonal shape as viewed in the press-fitting direction of the nut 80, and the recessed portions 63, which are formed in the four corners of the through hole 62. The recessed portions 63 are recessed toward the outer side of the through hole 62 to locally expand the contour of the through hole 62.

This structure forms the recessed portions 63 in the four corners of the through hole 62 that are recessed toward the outer side of the through hole 62 and locally expand the contour of the through hole 62. The formation of the recessed portions 63 allows for expansion of the space in the four corners of the through hole 62. This forms gaps between the corners 85 of the nut 80, which is press-fitted into the accommodation hole 61, and the corners of the accommodation hole 61 (i.e., corners 68 of recessed portion 63). The gaps allow for a tolerance of dimensional differences resulting from dimensional errors, thermal expansion differences, or the like. Thus, the nut 80 is accommodated in the accommodation hole 61 with a high rate of precision.

When the inner wall surface of a conventional nut accommodation portion does not include a rib, if the radius of roundness of the corner of the nut is smaller than the radius of roundness of the corner of the nut accommodation portion, the corner of the nut may interfere with the corner of the nut accommodation portion. This forms chips formed by scraping when the nut is press-fitted in the nut accommodation portion.

In contrast, in the above-described configuration, a gap is formed between the corner 85 of the nut 80 and the corner 68 of the accommodation hole 61. Thus, for example, even if the radius R of roundness of the corner 85 of the nut 80 is smaller than the radius R of roundness of the corner 68 of the accommodation hole 61, interference is restricted between the corner 85 of the nut 80 and the corner 68 of the accommodation hole 61. This decreases the chips formed by scraping when the nut 80 is press-fitted in the accommodation hole 61 and reduces a situation in which the chips collect on the bottom surface of the nut accommodation portion 60. Thus, decreases are limited in the positioning precision of where the nut 80 is fastened.

(2) Each of the four sides defining the contour of the accommodation hole 61 includes the straight portion 65, the two extensions 66, and the straight portion 67. The straight portion 65 extends straight. The extensions 66 respectively extend from two ends of the straight portion 65 toward the outer side of the through hole 62 in directions intersecting the straight portion 65. The straight portion 67 extends from the end of each extension 66 parallel to the straight portion 65. The recessed portion 63 is formed by the extensions 66 and the straight portions 67 of two adjacent ones of the four sides.

With this structure, each recessed portion 63 is formed by the extensions 66 and the straight portions 67 of two adjacent ones of the four sides defining the accommodation hole 61. The recessed portions 63 expand the space in the four corners of the through hole 62. Further, the straight portion 67 extends parallel to the straight portion 65. Thus, the contour of the accommodation hole 61 will not be as large as when, for example, the straight portion 67 is arcuate.

(3) Length L1 of the straight portion 65 is greater than length L2 of the extension 66 and the straight portion 67 in the direction parallel to the straight portion 65. With this structure, the straight portion 65, which forms the inner wall surface of the through hole 62, is longer than the extensions 66 and the straight portions 67, which form the inner wall surface of the recessed portions 63. This increases the length of abutment between the straight portion 65 and the corresponding side surface 83 of the nut 80 and increases the area of contact between the side surface 83 of the nut 80 and the inner wall surface of the accommodation hole 61. This avoids loosening of the nut 80 in the nut accommodation portion 60.

(4) Length L1 of the straight portion 65 is greater than length L3, which is the sum of two lengths L2. This structure increases the length of abutment between the straight portion 65 and the corresponding side surface of the nut 80. Thus, the area of contact is increased between the side surface of the nut 80 and the inner wall surface of the accommodation hole 61, and loosening of the nut 80 in the nut accommodation portion 60 is avoided.

(5) The inner wall surface of the through hole 62 forming the straight portion 65 is flat. That is, a rib or a projection is not formed on the inner wall surface of the through hole 62, which forms the straight portion 65. This increases the area of contact between the side surface 83 of the nut 80 and the inner wall surface of the through hole 62. Thus, loosening of the nut 80 in the nut accommodation portion 60 is avoided.

(6) The nut cover 90 covers the nut 80, which is accommodated in the nut accommodation portion 60. The nut cover 90 restricts movement of the nut 80 in a direction opposite to the press-fitting direction. In this manner, the nut cover 90 restricts movement of the nut 80 in a direction extending away from the nut accommodation portion 60. This avoids separation of the nut 80 from the nut accommodation portion 60.

(7) The connector housing 50 includes the guide grooves 72, which extends in a direction intersecting the press-fitting direction of the nut 80. The nut cover 90 includes the rail portions 93 and 94, which are slidable in the guide grooves 72. The nut cover 90 is a component separate from the connector housing 50.

In this structure, the nut cover 90 and the connector housing 50 are separate components. Thus, the nut cover 90 can be coupled to the connector housing 50 after the nuts 80 are accommodated in the nut accommodation portions 60. Further, the nut cover 90 can be coupled to the connector housing 50 by sliding the rail portions 93 and 94 of the nut cover 90 in the guide grooves 72 of the connector housing 50. This facilitates coupling of the nut cover 90.

(8) Multiple nut accommodation portions 60 are covered with the same nut cover 90. This facilitates coupling of the nut cover 90 as compared to when separate nut covers 90 are coupled to the nut accommodation portions 60.

The above-described embodiment may be modified as follows. The above embodiment and the following modifications can be combined as long as the combined modifications remain technically consistent with each other.

In the above embodiment, multiple nut accommodation portions 60 are covered with the same nut cover 90. However, there is no limitation to such a structure. For example, a separate nut cover may be coupled to each of the nut accommodation portions 60. For example, when the number of the nut accommodation portions 60 is two, two nut covers are coupled to the connector housing 50.

In the above embodiment, the nut cover 90 is coupled to the connector housing 50 in the front-rear direction X, which intersects the press-fitting direction of the nut 80. However, there is no limitation to such a structure. For example, the structure may be changed so that the nut cover 90 is coupled to the connector housing 50 in the press-fitting direction of the nut 80.

The nut cover 90 of the above embodiment may be omitted.

There is no particular limitation to the shape of the recessed portion 63 of the above embodiment. For example, the straight portion 67 may be changed to have an arcuate shape as viewed in the press-fitting direction of the nut 80.

In the above embodiment, the nut 80 has a square planar shape as viewed in the press-fitting direction. However, there is no limitation to such a structure. For example, the nut 80 may have a rectangular planar shape as viewed in the press-fitting direction. In this case, the through hole 62 will also have a rectangular planar shape as viewed in the hole-extending direction.

In the above embodiment, the connection terminal 40 includes the male terminal portion 41. However, there is no limitation to such a structure. For example, the connection terminal 40 may include a female terminal portion. In this case, for example, the wire-side connector 22 includes a male terminal portion.

There is no particular limitation to the number of the nut accommodation portions 60 of the connector 30 in accordance with the above embodiment. The number of the nut accommodation portions 60 may be one or greater than two.

There is no particular limitation to the number of the connection terminals 40 attached to the connector housing 50 of the above embodiment. The number of the connection terminals 40 may be one or greater than two.

The positional relationship of the inverter 11 and the high-voltage battery 12 in the vehicle is not limited to the above embodiment and may be changed in accordance with the structure of a vehicle.

In the above embodiment, the inverter 11 and the high-voltage battery 12 are employed as the electric devices connected by the electroconductive path 10. However, there is no limitation to this configuration. For example, the present disclosure may be employed to wires that connect the inverter 11 and a wheel driving motor. That is, the present disclosure is applicable to any connector that electrically connects electric devices mounted on a vehicle.

The present examples and embodiments are to be considered as illustrative and not restrictive. The scope of the present description is defined not by the above detailed description, but by the claims and their equivalents, and all variations within the scope of the claims and their equivalents are to be construed as being included in the disclosure.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

DESCRIPTION OF THE REFERENCE NUMERALS

10) electroconductive path, 11) inverter, 12) high-voltage battery, 15) case, 16) case body, 17) attachment portion, 17X) attachment hole, 18) fastening portion, 18X) bolt fastening hole, 20) wire harness, 21) wire, 22) wire-side connector, 23) protective tube, 30) connector, 40) connection terminal, 41) male terminal portion, 42) terminal connection portion, 43) through hole, 50) connector housing, 51) hood portion, 51X) accommodation groove, 52) insertion portion, 53) fastening portion, 53X) bolt insertion hole, 54) collar, 55) tubular portion, 55X) accommodation groove, 56) terminal holding portion, 57) holding hole, 58) partition wall, 60) nut accommodation portion, 61) accommodation hole, 62) through hole, 63) recessed portion, 65) straight portion (first straight portion), 66) extension, 67) straight portion (second straight portion), 68) corner, 69) front wall, 69X) hole, 70) side wall, 71) connecting wall, 72) guide groove, 73) lock protrusion, 76) rubber ring, 77) rubber ring, 80) nut, 81) upper surface, 82) lower surface, 83) side surface, 84) through hole, 85) corner, 90) nut cover, 91) cover, 91X) through hole, 92) coupling portion, 93) rail portion, 94) rail portion, 95) lock frame, 95X) engagement hole, 96) connecting portion, 100) mate terminal, 101) through hole, B1) bolt, B2) fastening bolt, L1) length, L2) length, L3) length, L4) distance, S1) interior

What is claimed is:

1. A connector, comprising:

a connector housing;

a connection terminal attached to the connector housing; and a nut accommodation portion, into which a nut is press-fitted and accommodated in a press-fitting direction, wherein the nut accommodation portion includes an accommodation hole extending through the connector housing in the press-fitting direction, and an end surface of the connection terminal exposed from the accommodation hole, the accommodation hole includes a through hole, which has a tetragonal shape as viewed in the press-fitting direction, and a recessed portion, which is formed in each of four corners of the through hole, and the recessed portion is recessed toward an outer side of the through hole to locally expand a contour of the through hole.

2. The connector according to claim 1, further comprising:

a nut cover that covers the nut accommodated in the nut accommodation portion, where the nut cover restricts movement of the nut in a direction opposite to the press-fitting direction.

3. The connector according to claim 2, wherein the connector housing includes a guide groove extending in a direction intersecting the press-fitting direction, the nut cover includes a rail portion slidable in the guide groove, and the nut cover is a component separate from the connector housing.

4. The connector according to claim 3, wherein the nut accommodation portion includes a plurality of nut accommodation portions, and the plurality of the nut accommodation portions is covered by the same one of the nut cover.

5. The connector according to claim 1, wherein each of four sides defining a contour of the accommodation hole includes a first straight portion extending straight, two extensions extending from two ends of the first straight portion toward the outer side of the through hole in directions that intersect the first straight portion, and a second straight portion extending from an end of each of the extensions parallel to the first straight portion, and the recessed portion is formed by the second straight portions and the extensions of two adjacent ones of the four sides.

6. The connector according to claim 5, wherein an inner wall surface of the through hole forming the first straight portion is flat.

7. The connector according to claim 5, wherein length L1 of the first straight portion is greater than length L2 of one of the extensions and the second straight portion in a direction parallel to the first straight portion.

8. The connector according to claim 7, wherein length L1 of the first straight portion is greater than length L3 that is a sum of two lengths L2.

9. The connector according to claim 8, wherein ratio L3/L1 of length L3 to length L1 is in a range of 0.3 to 0.7.

* * * * *